US006298513B1

(12) United States Patent
Rief et al.

(10) Patent No.: US 6,298,513 B1
(45) Date of Patent: Oct. 9, 2001

(54) POOL CLEANER WITH OPEN-ENDED PIN SUPPORTED FLAPPER VALVE

(75) Inventors: Dieter J. Rief; Manuela Rief, both of Santa Rosa, CA (US)

(73) Assignee: Poolvergnuegen, Santa Rosa, CA (US)

( * ) Notice: Subject to any disclaimer, the term of this patent is extended or adjusted under 35 U.S.C. 154(b) by 0 days.

(21) Appl. No.: 09/275,920

(22) Filed: Mar. 24, 1999

Related U.S. Application Data

(60) Provisional application No. 60/079,199, filed on Mar. 24, 1998.

(51) Int. Cl.[7] ..... E04H 4/16
(52) U.S. Cl. ..... 15/1.7
(58) Field of Search ..... 15/1.7

(56) References Cited

U.S. PATENT DOCUMENTS

| | | | |
|---|---|---|---|
| 4,023,227 | 5/1977 | Chauvier . | |
| 4,133,068 | 1/1979 | Hofmann . | |
| 4,152,802 | 5/1979 | Chauvier . | |
| 4,156,948 | 6/1979 | Chauvier et al. . | |
| 4,193,156 | 3/1980 | Chauvier . | |
| 4,208,752 | 6/1980 | Hofmann . | |
| 5,794,293 * | 8/1998 | Hoffinger | 15/1.7 |
| 5,970,557 * | 10/1999 | Supra | 15/1.7 |

FOREIGN PATENT DOCUMENTS

| | | | |
|---|---|---|---|
| 0 559 477 * | 9/1993 | (EP) | 15/1.7 |
| 2520422 | 1/1982 | (FR) . | |

* cited by examiner

*Primary Examiner*—Randall E. Chin
(74) *Attorney, Agent, or Firm*—Jansson, Shupe & Munger, Ltd.

(57) ABSTRACT

A domestic automatic swimming pool cleaner which randomly travels about and cleans the walls and bottom surfaces of a swimming pool includes two parallel or non-parallel impact tubes, the top ends of which are connected to a flexible suction hose which in turn is connected to the suction side of the pool's filter pump. The bottom ends of the tubes are served intermittent shots of water by a hinged self-starting flapper valve with an unrestricted upstream opening in the cleaner's pool surface contacting head. By the action of the valve alternately delivering pool water to the two tubes, kinetic forces are generated which move the automatic pool cleaner about the pool.

7 Claims, 4 Drawing Sheets

POOL CLEANER WITH OPEN-ENDED PIN SUPPORTED FLAPPER VALVE

This application claims the benefit of U.S. Provisional Application Ser. No. 60/079,199, filed Mar. 24, 1998, by applicants herein.

BACKGROUND OF THE INVENTION

1. Field of the Invention

This invention relates generally to a device for the automatic cleaning of swimming pools, and more specifically to an improved and efficient suction-type automatic swimming pool cleaner.

2. Description of the Prior Art

Prior art has shown that a swimming pool may be cleaned automatically by a device using a cleaning head which engages the pool surfaces to be cleaned and is connected to one or a pair of tubes (either parallel or non-parallel) with a valve mechanism that interrupts the flow of pool water through the cleaning device by either periodically interrupting the constant flow of water through the single tube, or alternately delivering water through either of the pair of tubes. These suction type automatic swimming pool cleaners are typically powered by the flow of water flowing from the pool through the cleaning head, past a flapper valve, through the tube (or tubes), through a flexible hose normally associated with suction cleaners, and finally drawn into the suction side of the pool's filter pump.

The prior art is most notably represented by Hofmann U.S. Pat. No. 4,208,752 (which is manufactured and sold under the Barracuda trademark) and Chauvier U.S. Pat. No. 4,023,227 (which is manufactured and sold under the Kreepy Krauly trademark). Each of these automatic swimming pool cleaners consists of a cleaning head which is made up of a bottom opening in a plastic base which admits pool water and the debris such as dirt and leaves. This head has an elastomer disc about it which surrounds the head and increases the collecting area, and further acts as a stabilizer for the pool cleaner assembly. As the pool water is drawn up through the head it passes through a restricting orifice, offset from the longitudinal axis of the flapper valve, which is necessary to get the unpinned (free-floating) flapper valve to cycle or startup. The flapper valve cycles and as it does, it interrupts the steady suction flow to the pool's filter pump. This on-off or flow shift, depending upon the device, is amplified by the impact tube or tubes and causes a vibratory force sufficient to move the cleaner about the pools surfaces in a random fashion.

However, the offset restricting orifice, while necessary to initiate the flapper valve reciprocation, significantly limits the size of the debris that can be collected by the cleaner. In addition, debris often becomes trapped in the restricting orifice, causing system shutdown and requiring frequent cleanouts. Furthermore, the hydraulic restriction created by the orifice causes an increased electrical load on the pool pump, thereby shortening the life of the system.

SUMMARY OF THE INVENTION

The present invention provides a domestic automatic swimming pool cleaner which randomly travels about and cleans the walls and bottom surfaces of a swimming pool. The inventive apparatus includes two parallel or non-parallel impact tubes, the top ends of which are connected to a flexible suction hose which in turn is connected to the suction side of the pool's filter pump. The bottom ends of the tubes are served intermittent shots of water by a hinged self-starting flapper valve with an unrestricted upstream opening in the cleaner's pool surface contacting head. By the action of the flapper valve alternately delivering pool water to the two tubes, kinetic forces are generated which move the automatic pool cleaner about the pool for cleaning.

The present invention thus provides an open-ended, suction-type automatic pool cleaner with a pin supported flapper valve. In the subject invention no restrictive orifice is needed upstream of the flapper valve as the flapper valve is self starting in itself. This feature permits the pool cleaner to accept large pieces of debris as well reducing the frictional drag which allows the pool pump to run under a lesser electrical load. This feature also permits the easy clean out of debris jams which is a problem in the prior art pool cleaners.

The flapper valve in the present invention cycles about a hinge or trunnion pin or shaft. This shaft can be locked to the flapper valve and extended laterally outward from the cleaner body to provide a power take-off to drive a steering mechanism, timing device or other option for the pool cleaner. The shaft also holds the flapper valve in position and provides an axis about which the flapper valve cycles in a precise arc of travel (it also moves sideways to ensure shutoff on the valve seats). As the flapper valve cycles back and forth, it strikes against the narrow stepped surfaces located outboard on both sides of the flapper valve. These surfaces act as a water seal to positively shut off the flow of water at the end point of cyclic travel of the flapper valve, and thus the system gets more kinetic impact derived from the water flow.

DETAILED DESCRIPTION OF A PREFERRED EMBODIMENT

Figure 1:
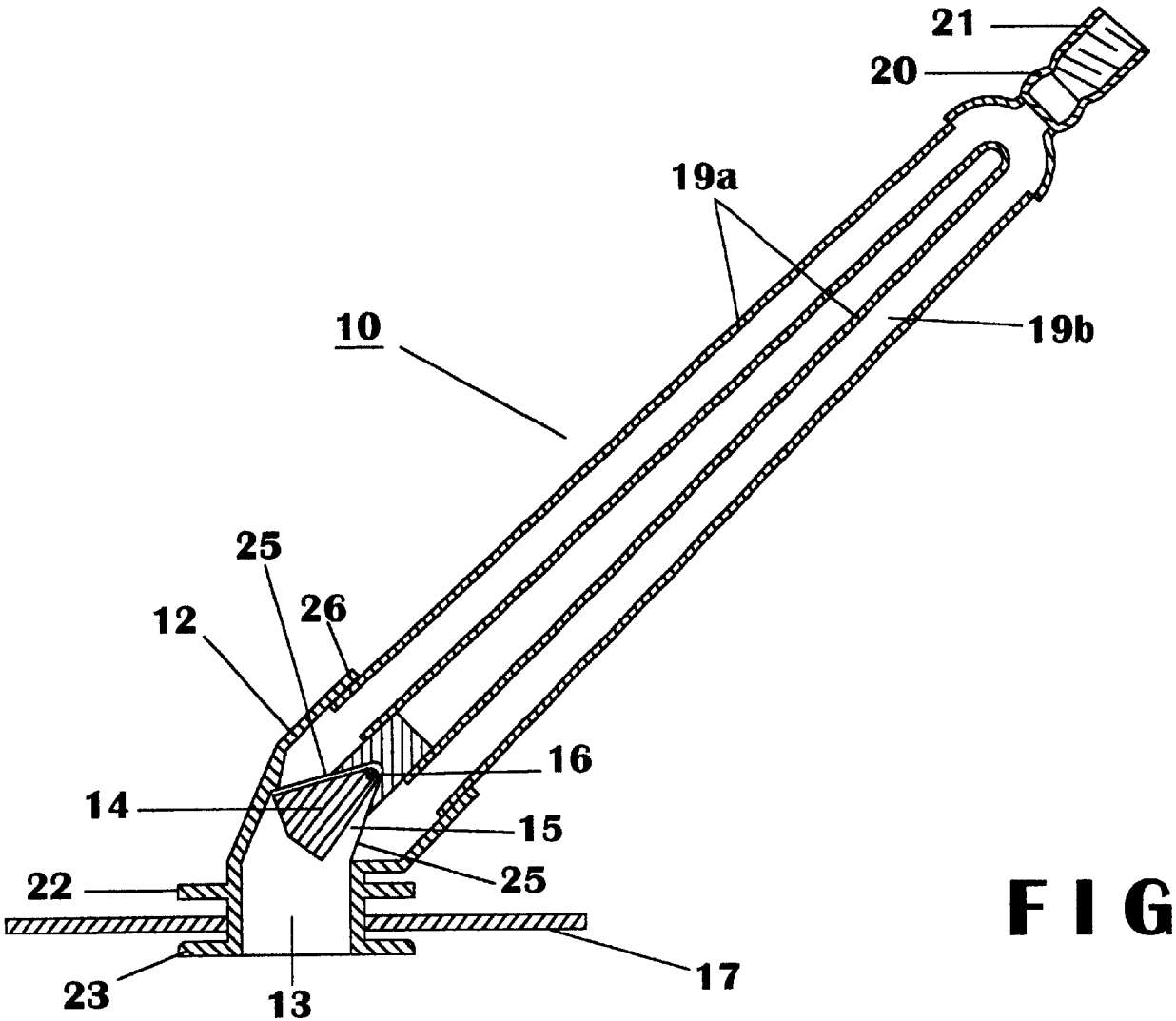
FIG. 1 is a side elevation cross-sectional view of a two impact tube configuration of the invention.
Figure 2:
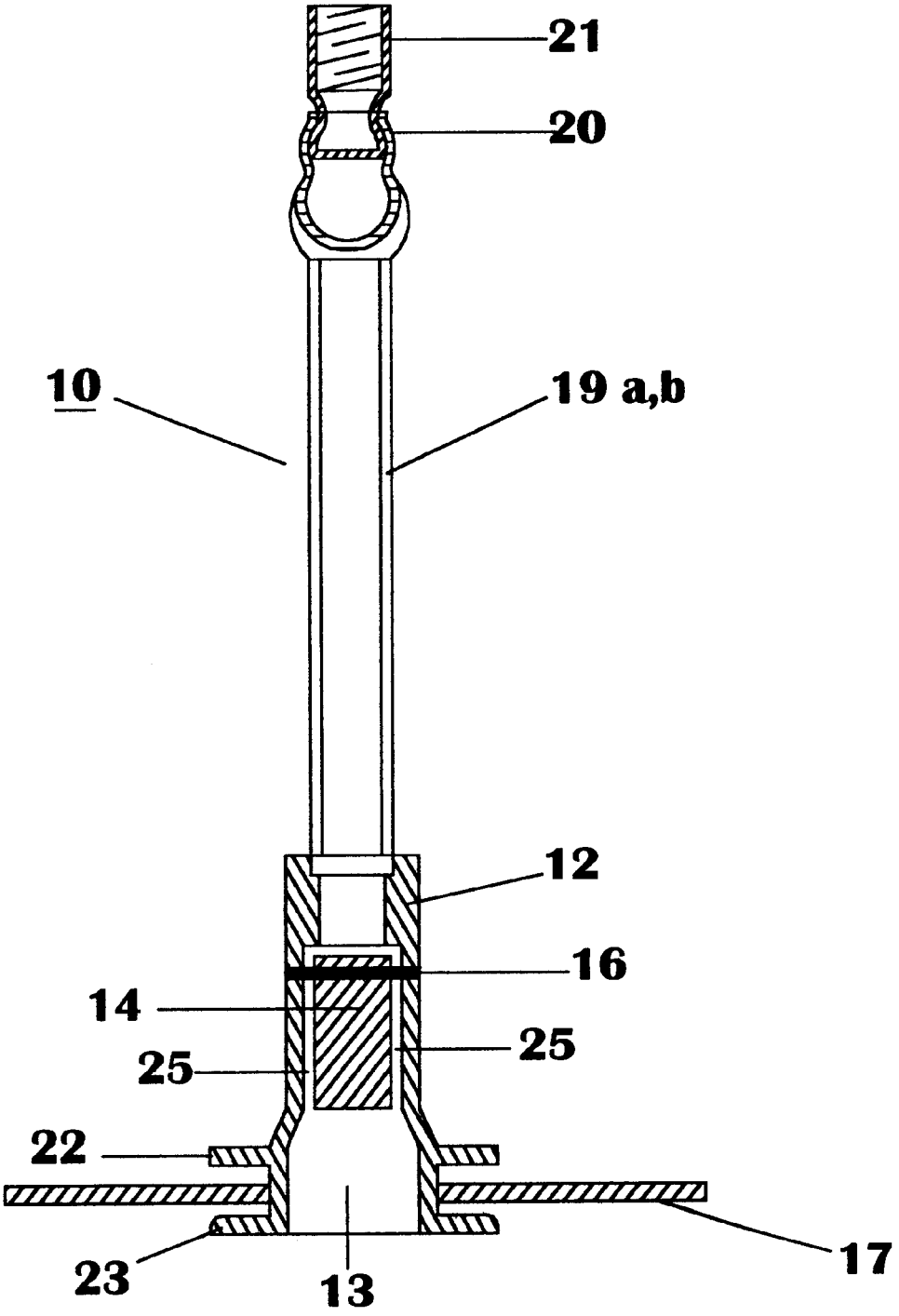
FIG. 2 is a front elevation cross-sectional view of the two impact tube configuration of FIG. 1, this view taken at 90 degrees to FIG. 1.

The invention is designed as an automatic swimming pool cleaner device. With reference to FIGS. 1 and 2, the automatic swimming pool cleaner apparatus 10 consists of a hollow head 12 which has within it a suction chamber 13 and above which is a generally triangular shaped flapper valve 14 with faces 15, pivoted about a shaft 16. About head 12 is a flexible disc 17 which is normally round in shape and held in place by upper flange 22 and lower flange 23. Above the flapper valve 14 in both the direction of water flow and normal operating orientation are two impact tubes 19*a*, 19*b* that are usually round in diameter and of a length depending upon the desired embodiment.

The water is directed into one impact tube 19*a* and then to the other impact tube 19*b* repetitively. The interruption of the flow generates an impact by the change in the water's kinetic energy which in turn reacts on the mass of the pool cleaner 10 and causes a vibratory motion that drives the pool cleaner 10 about the pool's containing surfaces. About and downstream of the impact tubes 19*a,* 19*b* a hollow swivel joint 20 may be installed to facilitate the freer movement of the pool cleaner 10 in both angular and rotary directions relative to the flexible suction hose 21 which is normally used with this type of suction powered automatic swimming pool cleaner 10. This flexible suction hose 21 carries the water from the pool cleaner 10 to the pool side (not shown) where it connects to the swimming pool filter (not shown) and it's pump (not shown).

As the flapper valve 14 cycles, it is stopped at both ends of it's travel arc by landing surfaces called seals 25. These seals 25 project inward from the interior of the hollow head 12 from both sides a short distance so as not to interfere with the water flow, but enough to stop the travel of the flapper valve 14 by the seals 25 without deformation or wear of either.

The whole pool cleaner 10 is primarily made of plastic parts, either injection, molded, blow molded or extruded for purposes of reducing manufacturing costs. The swimming pool cleaner shown in FIGS. 1 and 2 indicate numerous parts that in actual production could be made as one or integral with one another, for instance at the interface 26 of the hollow head 12 and the impact tubes 19*a,* 19*b*. The shaft 16 is generally made of stainless steel or plastic.

Figure 3:
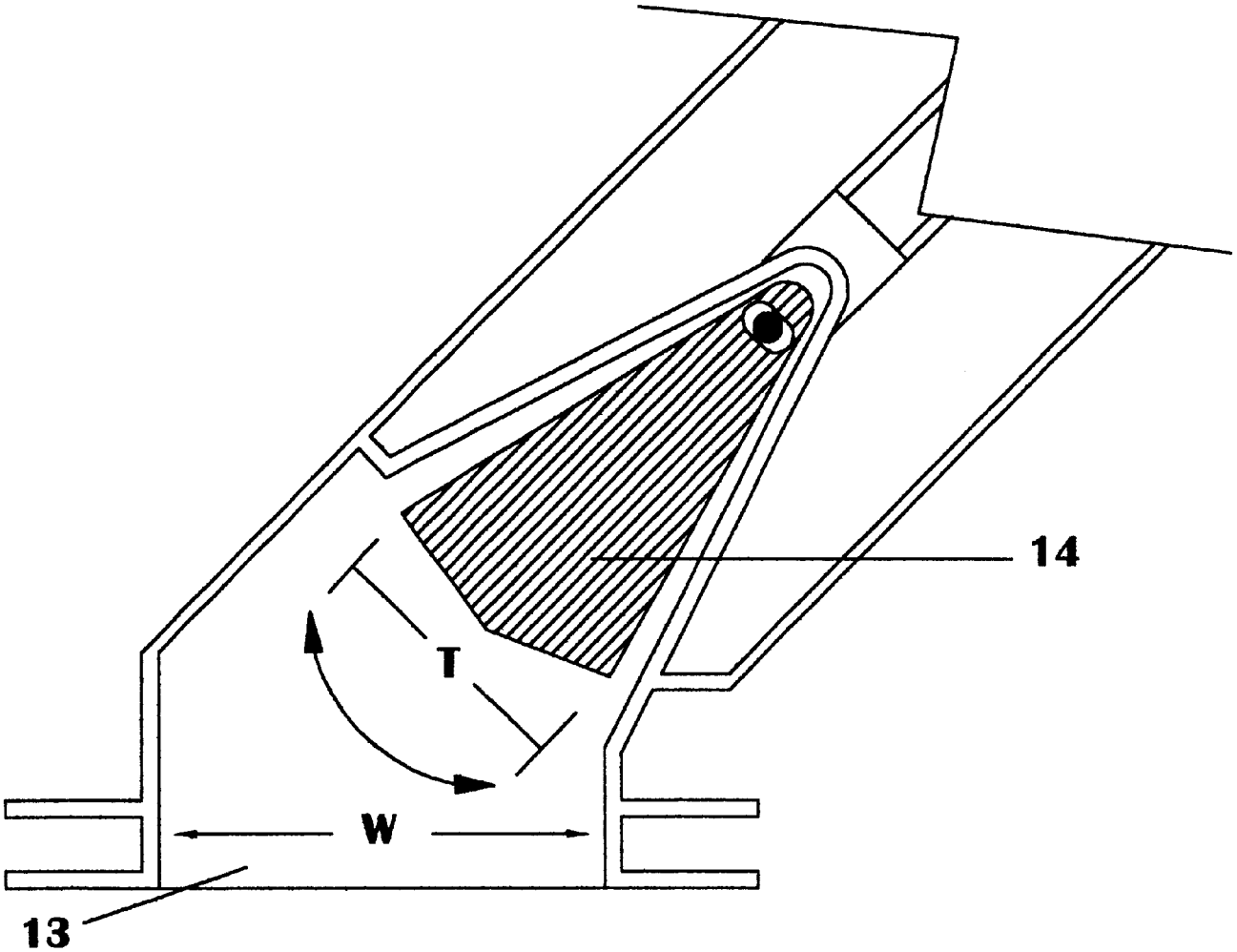
FIG. 3 is an enlarged side elevation cross-sectional view of the flapper valve in mid-cycle between the opposed seals.

FIG. 3 is an enlarged side elevation cross-sectional view of the flapper valve in mid cycle. Flapper valve 14 is preferably sized to have a thickness T that is between fifty-five to seventy percent of the unrestricted width W of suction chamber 13, in order for the opening to be entirely free and open. It is this unrestricted opening of suction chamber 13, enabled by the hinged capture and support of the flapper valve 14, that results in the invention's self-starting, increased capacity benefits.

Figure 4:
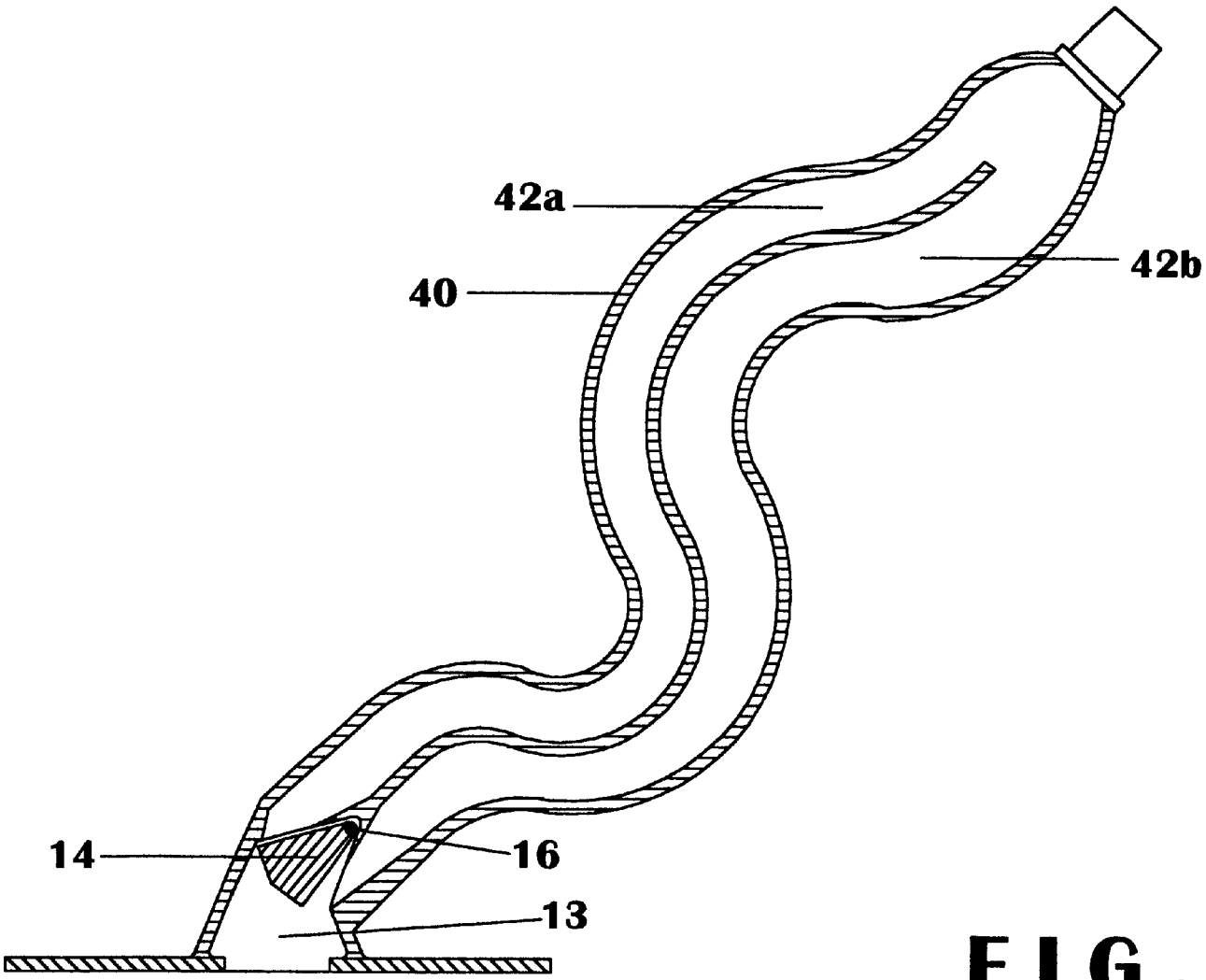
FIG. 4 is a side elevation cross-sectional view of an alternate, convolute-tube embodiment of the pool cleaner of this invention.

FIG. 4 is a side elevation cross-sectional view of an alternate, convolute-tube embodiment 40 of the pool cleaner of this invention. Here, impact tubes 42*a,* 42*b* may take the form of an S-shape (as illustrated) or other curve. Such a shape, preferably created in one piece by blow molding or vacuum forming, may be desirable to make the overall apparatus more compact.

While this invention has been describe in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. In a pool cleaning apparatus for automatically cleaning a pool's underwater surfaces, the pool cleaning apparatus including (a) a cleaning head having an opening adapted for releasable engagement with the surface to be cleaned; (b) a pair of suction tubes connected to the cleaning head; (c) a passageway connecting the opening to the pair of suction tubes; (d) a flapper valve within the passageway and adapted for reciprocation between the pair of suction tubes for alternately transferring in flowing liquid to one or the other of the suction tubes, the flapper valve having an upstream end spaced from the opening and a downstream end adjacent to the suction tubes, the passageway having an upstream portion extending from the opening to the upstream end of the flapper valve and the flapper valve having a thickness, the improvement comprising:

the downstream end of the flapper valve is hingedly connected to the cleaner head at a position between the suction tubes; and the upstream portion of the passageway is substantially unrestricted in that along its entire length between the opening and the upstream end of the flapper valve, the upstream portion has a width greater than the thickness of the flapper valve, whereby debris of substantial size freely enters and is removed by the pool cleaning apparatus.

2. The pool cleaning apparatus of claim 1 wherein the flapper valve thickness is about 55–70% of the width of the upstream portion of the passageway.

3. The pool cleaning apparatus of claim 1 wherein the suction tubes are straight.

4. The pool cleaning apparatus of claim 1 wherein the suction tubes are parallel.

5. The pool cleaning apparatus of claim 1 wherein the suction tubes are convolute.

6. The pool cleaning apparatus of claim 1 wherein the cleaning head includes a pair of valve seats and the flapper valve is adapted to reciprocate between the valve seats to impart a motive force to the cleaning head.

7. The pool cleaning apparatus of claim 1 wherein the flapper valve is hinged about a shaft interposed between the pair of suction tubes.

* * * * *